US005090976A

United States Patent [19]

Dyson

[11] Patent Number: 5,090,976

[45] Date of Patent: Feb. 25, 1992

[54] DUAL CYCLONIC VACUUM CLEANER WITH DISPOSABLE LINER

[75] Inventor: James Dyson, Bathford, England

[73] Assignee: Notetry Limited, England

[21] Appl. No.: 585,975

[22] Filed: Sep. 21, 1990

[51] Int. Cl.[5] ..... B01D 45/12

[52] U.S. Cl. ..... 55/337; 55/345; 55/429; 55/459.1; 55/DIG. 2; 55/DIG. 3

[58] Field of Search ..... 55/213, 215, 216, 337, 55/345, 429, 432, 459.1, 459.3, DIG. 2, DIG. 3

[56] References Cited

U.S. PATENT DOCUMENTS 4,229,193 10/1980 Miller ..... 55/DIG. 2 X
4,276,070 6/1981 Hug ..... 55/429
4,571,772 2/1986 Dyson .
4,573,236 2/1986 Dyson .
4,593,429 6/1986 Dyson .
4,643,748 2/1987 Dyson .
4,826,515 5/1989 Dyson .
4,853,008 8/1989 Dyson .
4,853,011 8/1989 Dyson .

*Primary Examiner*—Charles Hart
*Attorney, Agent, or Firm*—Ian C. McLeod

[57] ABSTRACT

A one piece plastic liner (40) for use in cyclonic vacuum cleaner (10) is described. The liner preferably fits inside of an outer cyclone or container (11) around an inner cyclone (12) and is held in place by the dirt receiver (13), the inner cyclone and the cover (15). The liner collects separated dirt from both cyclones and is easy to remove and replace by removing the cover, the inner cyclone and the receiver when the vacuum cleaner becomes full of dirt.

36 Claims, 3 Drawing Sheets

DUAL CYCLONIC VACUUM CLEANER WITH DISPOSABLE LINER

Figure 1:
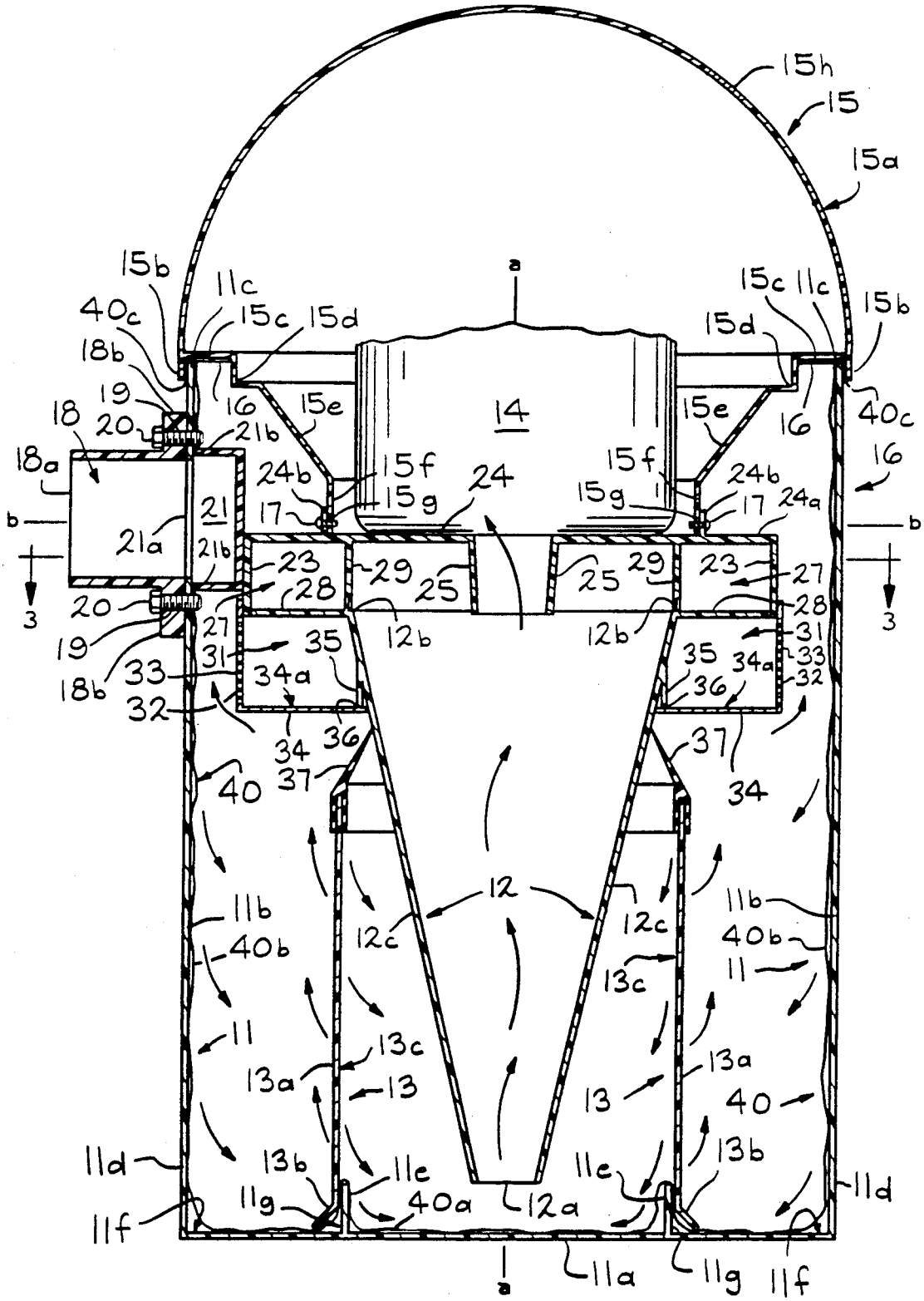

BACKGROUND OF THE INVENTION (1) Field of the Invention

The present invention relates to a disposable liner for a vacuum cleaner with dual inner and outer cyclones. In particular, the present invention relates to a liner that fits inside of an outer cyclone so that dirt separated from the airflow in both the inner and outer cyclones is deposited in the liner. In this manner, when the two cyclones become full of dirt and the vacuum cleaner is ready to be emptied, the operator can easily separate the inner cyclone with a dirt receiver from the outer cyclone, lift the liner out of the outer cyclone, replace a new liner and after positioning the inner cyclone and dirt receiver in place, resume vacuuming (2) Prior Art Dirt collection bags which are air permeable have been used in bag vacuum cleaners for a long time. However, the present invention represents the first time that a liner for collecting dirt has been used for a vacuum cleaner with a dual inner and outer cyclone in both cyclones. My U.S. Pat. No. 4,593,429 makes reference to a disposable liner provided for the low efficiency cyclone or outer cyclone. Cyclonic vacuum cleaning apparatus are shown in my U.S. Pat. Nos. 4,573,236; 4,593,429; 4,571,772; 4,643,748; 4,826,515; 4,853,011 and 4,853,008.

OBJECTS

It is therefore an object of the present invention to provide a disposable liner which fits between the two cyclones in a cyclonic vacuum cleaner with dual inner and outer cyclones. Further, it is an object of the present invention to provide a liner which can be easily removed and replaced by an operator when one or both of the cyclones in the vacuum cleaner become full of separated dirt. Still further, it is an object of the present invention to provide a liner which is inexpensive to manufacture and easy to use. These and other objects will become increasingly apparent to those skilled in the art and by reference to the drawings.

IN THE DRAWINGS

FIG. 1 is a front cross-sectional view showing liner 40 positioned between the inner cyclone 12 and the outer cyclone 15 and being held in place by the dirt receiver 13 and cover 15 on outer cyclone 11.

Figure 2:
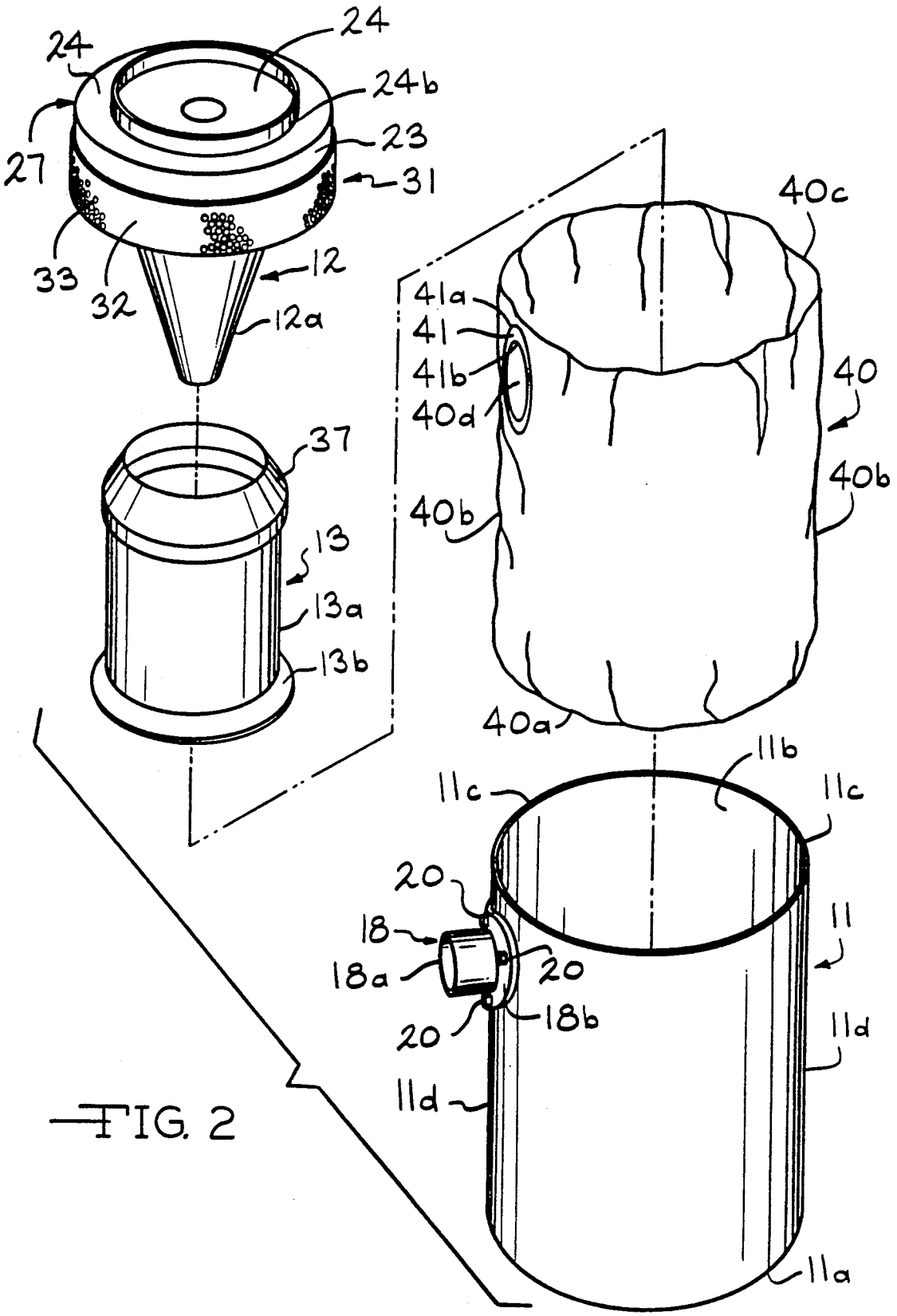

FIG. 2 is a separated view showing the positioning of the inner cyclone 12, shroud 31, inlet scroll 27 and dirt receiver 13 inside of the liner 40 which entire assembly fits inside of the outer cyclone 11.

Figure 3:
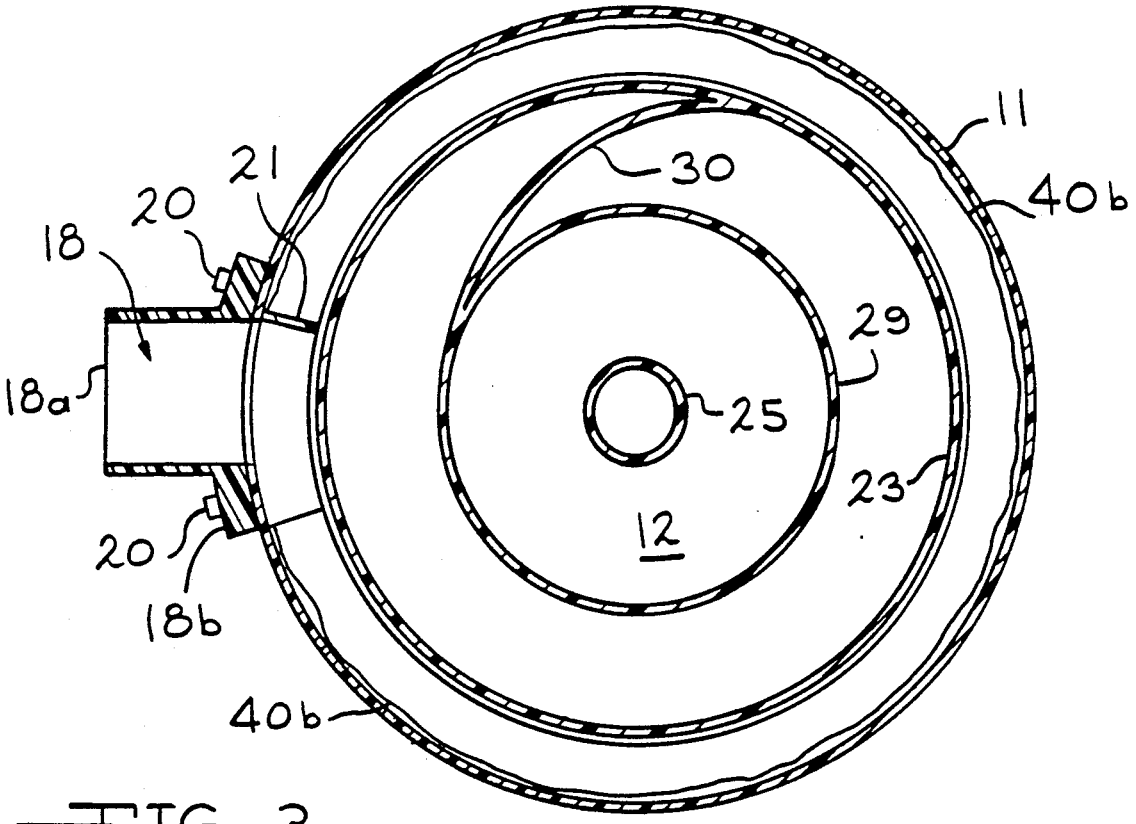

FIG. 3 is a plan cross-sectional view along line 3—3 of FIG. 1 showing the inlet passage 21 to the outer cyclone 11 with spiral member 30 for inlet into the inner cyclone 12.

GENERAL DESCRIPTION

The present invention relates to a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes, preferably sequentially, through the dirty air inlet, the container, the cyclone air inlet, the cyclone, the receiver and the cyclone air outlet, the airflow rotating around the frusto-conical interior surface of the cyclone and depositing the dirt in the receiver the improvement which comprises: the receiver having opposed ends, one of which is open, adjacent to the bottom of the container; and the container having a closure member projecting from the bottom of the container for removably mating with and closing the open end of the receiver; wherein in use a bag shaped liner is mounted in the container which covers the inside surface of the container including the closure member and the open end of the receiver between the closure member and the receiver.

A liner for use in a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes, preferably sequentially through the dirty air inlet, the container, the cyclone air inlet, the cyclone, the receiver and the cyclone air outlet, the airflow rotating around the frusto-conical interior surface of the cyclone and depositing the dirt in the receiver, the receiver having opposed ends, one of which is open, adjacent to the bottom of the container and the container having a closure member projecting from the bottom of the container for removably mating with and closing the receiver which comprises a bag shaped liner adapted to be mounted in the container so as to cover the inside of the container including the closure member and the bottom of the open end of the receiver and laying between the closure member and the receiver The liner used in the present invention can be made of plastic or paper, although the former is preferred. Preferably the liner is radially imperforate.

The liner could be used in either a modified upright vacuum cleaner similar to the type described in U.S Pat. Nos. 4,593,429 and 4,826,515 or in a canister type vacuum cleaner The canister type cleaner usually has a removable cover that exposes the liner. The upright vacuum cleaner has a fixed head which requires that the container be removed from the fixed head to expose the liner.

Preferably the liner fits inside of the outer cyclone and is held in place by the combined weight of the dirt receiver, inner cyclone, cover and motor fan unit. During operation of the vacuum cleaner, the dirt separating out of the airflow in the outer cyclone and the dirt from the inner cyclone are deposited in the receiver and contained by the liner. The liner works well because when the outer cyclone and the dirt receiver become full of dirt, the operator can easily lift the liner out of the outer cyclone and replace it with a new one. T separated dirt is now contained in the liner where it c be cleanly disposed of. The liner also works well in single cyclonic vacuum cleaners.

SPECIFIC DESCRIPTION

FIG. 1 shows a tank type vacuum cleaning apparatus 10, which comprises an outer cyclone or container 11, around an inner cyclone 12, a dirt collecting receiver 13 for the inner cyclone 12 and a motor driven fan unit 14. The inner and outer cyclones 11 and 12 have circular cross-sections along a longitudinal axis a—a. The outer cyclone 11 has a bottom wall 11*a* and a sidewall 11*b* which extends from the outer periphery of the bottom wall 11*a*. A removable cover 15 with a hemispherical outer surface 15*a* and depending lip 15*b* fits over the top of outer cyclone 11. Extending inwardly from lip 15*b* toward the axis a—a is horizontal support web 15*c* which meets the upper edge of a right angle cross-sectioned protrusion 15*d*. An annular gasket 16 is mounted between protrusion 15*d* and lip 15*b* on web 15*c* so as to be in contact with the upper edge 11*c* of cylindrical sidewall 11*b*. The gasket 16 acts to seal the cover 15 to the outer cyclone 11 while the apparatus 10 is in operation. The lower edge of protrusion 15*d* meets the top edge of frusto-conical section 15*e* which tapers radially inwardly and downwardly toward the axis a—a. An annular ring member 15*f* depends from the distal end of frusto-conical section 15*e* and has openings 15*g* for bolts 17. Openings 15*h* are provided on the hemispherical surface 15*a* which serve as an exhaust port for motor fan unit 14.

A cylindrical dirty air inlet passage 18 communicates through the upper part of the outer surface 11*d* of sidewall 11*b* of cyclone 11. The end port 18*a* of the dirty air inlet passage 18, remote from the outer cyclone 11, is joined by a flexible tube (not shown) to a cleaner head (not shown) for contacting a dirty surface. Flanged section 18*b* of inlet passage 18, adjacent to the outer surface 11*d* of cyclone 11, has openings 19 for bolts 20 to secure the inlet passage 18 to the outer surface 11*d* of cyclone 11. Inlet passage 18 leads to a dirty air inlet passage 21 which communicates through the upper part of the sidewall 11*b* of outer cyclone 11 so as to make a tangential entry and to set up a swirling, cyclonic flow of air in the outer cyclone 11.

A plate 24, circular in plan view, with dependent tube 25 centered around axis a—a is positioned above the inner cyclone 12. The dependent tube 25 extends downwardly along axis a—a from the plate 24 substantially coaxially with the inner cyclone 12. The motor driven fan unit 14 is located on the plate 24 and is arranged so as to draw air from the inner cyclone 12 through dependent tube 25. Extending from the top side 24*a* of the plate 24 is annular ring member 24*b* which is outside of and adjacent to depending ring member 15*e*. Annular ring 24*b* has openings 26, centered on the axis b—b coinciding with openings 15*f* in depending ring member 15*e*, which enable the bolts 17 to secure the cover 15 to the plate 24.

The inner cyclone 12 has a frusto-conical body extending radially downwardly and inwardly towards axis a—a to a cone opening 12*a* and a dependent inlet scroll 27. The inlet scroll 27 comprises the sleeve 23 which depends from the plate 24 to a horizontal annular web 28 (FIGS. 1 and 3). The web 28 extends between the upper end 12*b* of a frusto-conical body of cyclone 12 and the lower end part of sleeve 23. A second dependent sleeve 29 extends between the cover 24 and the junction of the upper end 12*b* of the frusto-conical body and the web 28. The second sleeve 29 is located radially inwardly of the tubular sleeve 23 and through the majority of its length extends from the upper end 12*b* of the frusto-conical body where the upper end 12*b* joins the inner periphery of the web 28. As shown in FIG. 3, a portion 30 of the second sleeve 29 extends, in the form of a spiral, from the junction of the upper end 12*b* frusto-conical body and the web 28 to the tubular sleeve 23 thereby completing the inlet scroll 27 and providing a tangential entry to the inner cyclone 12 in order to be capable of setting up a swirling cyclonic flow of air. The spiral of inlet scroll 27 and the tangential entry to inner cyclone 12 is described more fully in my U.S. Pat. No. 4,826,515.

Depending from scroll 27 and spaced from the outside wall 12*c* of the inner cyclone 12 is a shroud 31 which comprises of tubular ring 32 that depends from the junction of tubular sleeve 23 and web 28. The ring 32 of shroud 31 is totally perforated with a plurality of openings 33 (partially shown in FIG. 2) that serve as an air inlet from the outer cyclone 11 to scroll 27 leading into the inner cyclone 12. The tubular ring 32 is parallel to and spaced from the inside wall 11*b* of the outer cyclone 11. For upright vacuum cleaners, the distance preferably ranges between 0.59 inches to 1.18 inches (1.5 cm to 3.0 cm) and for tank type vacuums the distance preferably ranges between 0.75 inches to 1.26 inches (2.0 cm to 3.2 cm). The diameters are between about 10.63 inches (27.0 cm) for the outer cyclone 11 and 8.11 inches (20.6 cm) for the ring 32. The preferred distance between the tubular ring 32 and the inside wall 11*b* of the outer cyclone 11 is dependent on the diameters of the outer cyclone 11 and the inner cyclone 12. The shroud 31 is completed by a web 34 that extends between the lower end portion of ring 32 and the outside wall 12*c* of the inner cyclone 12 and a cylindrical support member 35 that depends from the outside wall 12*c* of the inner cyclone 12 and which with the upper surface 34*a* of web 34 forms a right angle closure from outer cyclone 11 at intermediate seal 36.

The dirt collection receiver 13 for the inner cyclone 12 comprises a cylindrical portion 13*a* which meets the upper edge of a frusto-conical section 13*b* extending downwardly and outwardly from the axis a—a to the bottom wall 11*a* of outer cyclone 11. Adjacent to and radially inward from frusto-conical section 13*b* is the annular ring member 11*e* of outer cyclone 11 which extends beyond the upper edge of frusto-conical section 13*b* adjacent to the inner surface 13*c* of cylindrical portion 13*a* of receiver 13, thus forming a seal between receiver 13 and outer cyclone 11. The cylindrical portion 13*a* is positioned between the inside wall 11*b* of the outer cyclone 11 and outside wall 12*c* of the inner cyclone 12 and projects upward from the frusto-conical section 13*b* to a distance about 7.0 inches (18.0 cm) below the web 34 of ring 32. The receiver 13 is completed by a rubber seal 37 that extends from the top of the cylindrical portion 13*a* to the outside wall 12*c* of the inner cyclone 12 adjacent to web 34.

A liner 40 which is made of a plastic or paper material such as polyethylene fits inside of the outer cyclone 11 and allows an operator to empty the vacuum cleaner apparatus 10 easily and without risk of spilling the separated dirt. The liner 40 is fitted inside the outer cyclone 11 when the inner cyclone 12, receiver 13, motor fan unit 14 and cover 15 are separated from the outer cyclone 11 for emptying and cleaning the outer cyclone 11. When fitting the liner 40, a bottom wall section 40*a* overlaps the inner surface 11*f* of the bottom wall 11*a* of the outer cyclone 11. The bottom wall section 40*a* extends to and meets with a cylindrical section 40*b* which extends up the inner wall 11*b* of the outer cyclone 11 to a distal end 40*c* that overhangs the upper edge 11*c* of the outer cyclone 11. An opening 40*d* near the upper edge of the cylindrical section 40*b* provides for the dirty air inlet passage 21 (see FIG. 2). The opening 40*d* is provided with a flexible gasket 41 that has an outer periphery 41*a* and an inner periphery 41*b* around opening 40*d* which seals against the outer periphery 21*b* of inlet passage 21 along the axis b—b. The gasket 41 is provided with a contact adhesive to provide the seal with inlet passage 21. The liner 41 is wider at the bottom wall section 40*a* to accommodate the annular ring member 11*e*.

When the cleaning apparatus 10 is fully assembled, the bottom wall section 40*a* of the liner 40 is trapped between the outside wall 11*g* of annular ring member 11*e* and the lower portion of the inside wall 13*c* of receiver 13, thereby forming a seal between the outer cyclone 11 and receiver 13. In a similar manner, the distal end 40*c* of the cylindrical section 40*b* of liner 40 and gasket 16 act to seal the upper edge 11*c* of outer cyclone 11 and the depending lip 15*b* and horizontal support web 15*c* of cover 15.

It is intended that the foregoing description be only illustrative of the present invention and that the present invention be limited only by the hereinafter appended claims.

I claim:

1. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver the improvement which comprises:

(a) the receiver having opposed ends, one of which is open, adjacent to the bottom of the container; and (b) the container having a closure member projecting from the bottom of the container for removably mating with and closing the open end of the receiver;

(c) wherein in use a bag shaped liner means is mounted in the container on the inside surface of the container including the closure member and the open end of the receiver between the closure member and the receiver so that the liner means has the shape of the interior surface of the container and wherein the liner means provides for collecting the dirt separated from the airflow, passing through the cleaning apparatus, by the container and by the cyclone in the receiver.

2. The cleaning apparatus of claim 1 wherein the open end of the receiver is in closely spaced relationship to the bottom of the container.

3. The cleaning apparatus of claim 2 wherein the open end of the receiver has a section adjacent to the closure member which is tapered outward towards the sidewall of the container.

4. The cleaning apparatus of claim 1 wherein the opposite end of the receiver from the end adjacent to the bottom is provided with a seal which mounts on an outside surface of the cyclone so that the cyclone is removable from the receiver and the receiver is removable from the container.

5. The cleaning apparatus of claim 1 wherein the cleaning apparatus is provided with a removable cover over an open end of the container, wherein the cover supports the cyclone so that the cyclone is removable with the cover from the container and wherein the liner means is disposed between the open end of the container and the cover.

6. The cleaning apparatus of claim 5 wherein the means for generating an airflow is mounted on the cover so as to draw air through the outlet from the cyclone.

7. The cleaning apparatus of claim 1 wherein an opening is provided through the liner means for mounting around the dirty air inlet.

8. The cleaning apparatus of claim 7 wherein a sealing means is provided around the opening in the liner means.

9. The cleaning apparatus of claim 8 wherein the opening in the liner means is provided with a contact adhesive which engages the inside surface of the container around the dirty air inlet.

10. The cleaning apparatus of claim 1 wherein the container is open at one end and separable from a support for the cyclone and wherein the liner means is disposed between the support and the open end of the container.

11. The cleaner apparatus of claim 1 wherein a perforated shroud is provided around the cyclone in the container adjacent to the inlet to the cyclone and the liner means.

12. The cleaning apparatus of claim 11 wherein the open end of the receiver is in closely spaced relationship to the bottom of the container and wherein the open end of the receiver has a section adjacent to the closure member which is tapered outward towards the sidewall of the container.

13. The cleaning apparatus of claim 11 wherein the open end of the receiver is in closely spaced relationship to the bottom of the container, wherein the open end of the receiver has a section adjacent to the closure member which is tapered outward towards the sidewall of the container and wherein the opposite end of the receiver from the end adjacent to the bottom is provided with a seal which mounts on an outside surface of the cyclone so that the cyclone is removable from the receiver and the receiver is removable from the container.

14. The cleaning apparatus of claim 1 wherein the open end of the receiver is in a closely spaced relationship to the bottom of the container, wherein the open end of the receiver has a section adjacent to the closure member which is tapered outward towards the sidewall of the container, and wherein the opposite end of the receiver from the end adjacent to the bottom is provided with a seal which mounts on an outside surface of the cyclone so that the cyclone is removable from the receiver and the receiver is removable from the container, wherein the cleaning apparatus is provided with a removable cover over an open end of the container, wherein the cover supports the cyclone so that the cyclone is removable with the cover from the container and wherein the liner means is disposed between the open end of the container and the cover.

15. The cleaning apparatus of claim 1 wherein the open end of the receiver is in a closely spaced relationship to the bottom of the container, wherein the open end of the receiver has a section adjacent to the closure member which is tapered outward towards the sidewall of the container, and wherein the opposite end of the receiver from the end adjacent to the bottom is provided with a seal which mounts on an outside surface of the cyclone so that the cyclone is removable from the receiver and the receiver is removable from the container, wherein the cleaning apparatus is provided with a removable cover over an open end of the container wherein the cover supports the cyclone so that the cyclone is removable with the cover from the container and wherein the liner means is disposed between the open end of the container and the cover and wherein the means for generating an airflow is mounted on the cover so as to draw air through the outlet from the cyclone.

16. The cleaning apparatus of claim 1 wherein the open end of the receiver is in a closely spaced relationship to the bottom of the container, wherein the open end of the receiver has a section adjacent to the closure member which is tapered outward towards the sidewall of the container, and wherein the opposite end of the receiver from the end adjacent to the bottom is provided with a seal which mounts on an outside surface of the cyclone so that the cyclone is removable from the receiver and the receiver is removable from the container, and wherein the container is open at one end and separate from a support for the cyclone and wherein the liner means is disposed between the support and the open end of the container.

17. The cleaning apparatus of claim 1 wherein the open end of the receiver is in a closely spaced relationship to the bottom of the container, wherein the open end of the receiver has a section adjacent to the closure member which is tapered outward towards the sidewall of the container, and wherein the opposite end of the receiver from the end adjacent to the bottom is provided with a seal which mounts on an outside surface of the cyclone so that the cyclone is removable from the receiver and the receiver is removable from the container, wherein the container is open at one end and separate from a support for the cyclone and wherein the liner means is disposed between the support and the open end of the cyclone and wherein a perforated shroud is provided around the inlet to the cyclone in the container.

18. A bag shaped liner means for use in a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the receiver having opposed ends, one of which is open, adjacent to the bottom of the container and the container having a closure member projecting from the bottom of the container for removably mating with and closing the receiver which comprises:

the bag shaped liner means adapted to be mounted in the container to lay over the inside of the container including the closure member and the bottom of the open end of the receiver and laying between the closure member and the receiver so that the liner means has the shape of the interior surface of the container and wherein the liner means provides for collecting the dirt separated from the airflow, passing through the cleaning apparatus, by the container and by the cyclone in the receiver.

19. The liner means of claim 18 with an opening to be positioned around the dirty air inlet to the container.

20. The liner means of claim 19 wherein a sealing means is provided around the opening in the liner means.

21. The liner means of claim 20 wherein the opening in the liner means is provided with a contact adhesive which engages the inside surface of the container around the dirty air inlet.

22. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface, and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver the improvement which comprises:

(a) a liner means for the cleaning apparatus with the container having an annular ring which extends from the interior surface at the bottom of the container, the annular ring being radically inside of and adjacent to an inside surface of a sidewall of the receiver, the annular ring having an inside surface and an outside surface, the outside surface of the annular ring and the inside surface of the sidewall of the receiver forming a closure at an open end of the receiver, and the container having an open end opposite the bottom of the container; and (b) a cover for the open end of the container, the cover supporting the cyclone with the receiver positioned between the container and the cyclone and the cover having an annular gasket adjacent to the open end of the container;

(c) wherein the liner means lays over the interior surface of the sidewall and the bottom of the container so that the liner means has the shape of the interior surface of the container the liner means further laying over the annular ring, the open end of the receiver adjacent to the bottom of the container and laying between the outside surface of the annular ring and the inside surface of the sidewall of the receiver and the bottom of the container, the liner means having a section extending to and laying over an upper edge of the open end of the container so that when the cyclone and the receiver are positioned inside of the container, the section of the liner means laying over the open end of the container is provided between the upper edge of the open end of the container and the annular gasket on the cover, which gasket serves as a seal with the liner means between the cover and the upper edge of the container so that the cover, cyclone, and receiver secure the liner means in position when the vacuum apparatus is assembled, wherein the liner means collects the dirt separated from the airflow in the container and by the cyclone in the receiver so that when the cover, cyclone, and receiver are separated from the container, the liner means can be lifted out of the container for removing the collected dirt from the vacuum cleaning apparatus.

23. The apparatus of claim 22 wherein the liner means is provided with an opening adjacent to the container sidewall, said opening providing for the dirty air inlet to the container.

24. The apparatus of claim 22 wherein the liner means is constructed in a one piece design.

25. The apparatus of claim 21 wherein the liner means is constructed of a plastic.

26. The apparatus of claim 22 wherein the dirty air inlet opening in the liner means is circular.

27. In a cleaning apparatus including a container comprising a bottom and a sidewall extending to an meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface, and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver the improvement which comprises:

(a) the container having an annular ring which extends from the interior surface at the bottom of the container, the annular ring being radially inside of and adjacent to an inside surface of a sidewall of the receiver and having an inside surface and an outside surface, the outside surface of the annular ring and the inside surface of the sidewall of the receiver forming a closure for the receiver at an open end of the receiver, and the container having an open end opposite the bottom of the container;

(b) a cover for the open end of the container, the cover supporting the cyclone with the receiver positioned between the container and the cyclone and the cover having an annular gasket adjacent to the open end of the container;

(c) a liner means laying over the interior surface of the sidewall and the bottom of the container so that the liner means has the shape of the interior surface of the container, the liner means further laying over the annular ring, the open end of the receiver adjacent to the bottom of the container, the inside surface of the annular ring and laying between the outside surface of the annular ring and the inside surface of the sidewall of the receiver and the bottom of the container, the liner means having a section extending to and laying over an upper edge of the open end of the container so that when the cyclone and the receiver are positioned inside of the container, the section of the liner means laying over the open end of the container is provided between the upper edge of the open end of the container and the annular gasket on the cover which gasket serves as a seal with the liner means between the cover and the upper edge of the container so that the cover, cyclone, and receiver secure the liner means in position when the vacuum apparatus is assembled, wherein the liner means collects the dirt separated from the airflow in the container and by the cyclone in the receiver so that when the cover, cyclone and receiver are separated from the container, the liner means can be lifted out of the container for removing the collected dirt from the vacuum cleaning apparatus.

28. The liner means of claim 27 wherein the liner means is provided with an opening adjacent to the container sidewall, said opening providing for the dirty air inlet to the container.

29. The liner means of claim 27 wherein the liner means is constructed in a one piece design.

30. The liner means of claim 27 wherein the liner means is constructed of a plastic.

31. The liner means of claim 28 wherein the dirty air inlet opening in the liner means is circular.

32. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface, and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver the improvement which comprises:

(a) the container having an annular ring which extends from the interior surface at the bottom of the container, and which annular ring is radially inside of an adjacent to an inside surface of a sidewall of the receiver, and the annular ring having an inside surface and an outside surface, the outside surface of the annular ring and the inside surface of the sidewall of the receiver forming a closure for the receiver and the container having an open end opposite the bottom; and (b) a cover for the open end of the container, the cover supporting the cyclone with the receiver positioned between the container and the cyclone and the cover having an annular gasket adjacent to the open end of the container;

(c) wherein the container provides for mounting a liner means that lays over the interior surface of the sidewall and the bottom of the container so that the liner means has the shape of the interior surface of the container, the liner means further laying over the annular ring, the open end of the receiver adjacent to the bottom of the container, the inside surface of the annular ring and laying between the outside surface of the annular ring and the inside surface of the sidewall of the receiver and the bottom of the container, the liner means having a section extending to and laying over an upper edge of the open end of the container so that when the cyclone and the receiver are positioned inside of the container, the section of the liner means laying over the open end of the container is provided between the upper edge of the open end of the container and the annular gasket on the cover which gasket serves as a seal with the liner means between the cover and the upper edge of the container so that the cover, cyclone, and receiver secure the liner means in position when the vacuum apparatus is assembled, wherein the liner means collects the dirt separated from the airflow in the container and the cyclone in the receiver so that when the cover, cyclone and receiver are separated from the container, the liner means can be lifted out of the container for removing the collected dirt from the vacuum cleaning apparatus.

33. The apparatus of claim 32 wherein the liner means is provided with an opening adjacent to the container sidewall, said opening providing for the dirty air inlet to the container.

34. The apparatus of claim 32 wherein the liner means is constructed in a one piece design.

35. The apparatus of claim 32 wherein the liner means is constructed of a plastic.

36. The apparatus of claim 32 wherein the dirty air inlet opening in the liner means is circular.

* * * * *